US006918501B2

(12) United States Patent
Wang et al.

(10) Patent No.: US 6,918,501 B2
(45) Date of Patent: Jul. 19, 2005

(54) STRENGTHENED DOOR FOR A BLAST-RESISTANT CARGO CONTAINER

(75) Inventors: Ming-Jong Wang, Hsinchu Hsien (TW); Feng-Ho Wang, Hsinchu Hsien (TW); Chao-Chyun An, Hsinchu (TW); Buh-Shiuh Teng, Taichung Hsien (TW)

(73) Assignee: Industrial Technology Research Institute (TW)

( * ) Notice: Subject to any disclaimer, the term of this patent is extended or adjusted under 35 U.S.C. 154(b) by 116 days.

(21) Appl. No.: 10/402,833

(22) Filed: Mar. 28, 2003

(65) Prior Publication Data

US 2004/0011789 A1 Jan. 22, 2004

(30) Foreign Application Priority Data

Apr. 1, 2002 (TW) ..... 91204111 U

(51) Int. Cl.[7] ..... B65D 88/00

(52) U.S. Cl. ..... 220/1.5; 220/324; 220/560.07; 312/140

(58) Field of Search ..... 220/1.5, 1.6, 252, 220/812, 813, 811, 817, 560.04, 560.05, 560.07; 312/409, 140

(56) References Cited

U.S. PATENT DOCUMENTS

| | | | | |
|---|---|---|---|---|
| 5,599,082 A | | 2/1997 | Mlakar et al. | |
| 6,019,237 A | | 2/2000 | Durham et al. | |
| 6,089,398 A | * | 7/2000 | Weinstein | 220/324 |
| 6,237,793 B1 | | 5/2001 | Fingerhut et al. | |

* cited by examiner

*Primary Examiner*—Lien M. Ngo
(74) *Attorney, Agent, or Firm*—Osha Liang L.L.P.

(57) ABSTRACT

An strengthened door for an blast-resistant cargo container includes a door panel horizontally slidably mounted on the cargo container. The door panel has an upper side, a lower side, a first vertical side and a second vertical side each hooked on the cargo container to provide overlapping joints to effectively limit blast damage to the inside of the cargo container and prevent an aircraft from being damaged.

7 Claims, 7 Drawing Sheets

STRENGTHENED DOOR FOR A BLAST-RESISTANT CARGO CONTAINER

BACKGROUND OF THE INVENTION

1. Field of the Invention

The present invention relates to a strengthened door, and more particularly to a strengthened door for the cargo container need to resist explosive blast.

2. Description of Related Art

A cargo container must have a door pivotally mounted on it to selectively close the cargo container for loading and unloading goods. However, the conventional door for a cargo container does not have a strengthened design or device to resist an explosive blast.

Over a decade, airplanes have become a primary target for terrorist attack, and many people have lost their lives in plane crashes due to terrorist bombs attached in checked baggage. To prevent those tragedies from happening, a lot of efforts have been made in the field of blast-resistant containers.

According to analysis and experiments, the blast-resistant cargo container need to take the blast pressure tens of times greater than the payload of the conventional cargo container. It means that all the surrounding four edges of the door panel must take very great tensile forces under such great explosive pressure in the container. Therefore, the requirements of the door of a blast-resistant cargo container are not only that the door is moveable to be opened and closed for receiving foods as usual, but also that all the four edges of the door panel must be strongly connected to its adjacent container panels under a blast. Hence, the door of conventional cargo container without strengthened design is very vulnerable to the explosive blast.

Many blast-resistant cargo containers have been granted patents by the USPTO, such as U.S. Pat. No. 5,599,082, 6,019,237, and 6,237,793. U.S. Pat. No. 5,599,082 is a hardened aircraft unit load device, which door has a pair of opposed crooked fingers or a T-shaped flange attached along part of the edge of the door to establish a bite for strongly connecting the door panel and its adjacent panels. But the "bite" or interlock mechanism can only be applied to a part of the surroundings of the door. Although another mechanism of "abutment of two contact plates" is offered to compensate, it is not reliable in reality. Hence, there are only a part of the edges (not all four edges) of the door panel can be really strongly connected. It is prone to failure at the non-strongly connected edge when explosion occurs.

U.S. Pat. No. 6,019,237 is a modified container using an inner bag to resist the blast. The bag member includes multiple overlapping door frame folds to reduce the force between the door and the bag opening frame. However, the unreliable mechanism may result in that the length of the connector between the door and the opening frame is too short to resist explosive blast.

U.S. Pat. No. 6,237,793 discloses an explosion resistant aircraft cargo container having a door with two side edges and a bottom edge that can securely connect to its adjacent panels. But the door panel is flexible, i.e., the container door has a curtain design. When opened, the door panel has to be folded several times to complete the operation. Obviously, some damages may occur inside the door panel along the folds after some time of operation. It is a very serious situation for the blast-resistant cargo container because the crews couldn't see the damages to the panel from the outside when interior damages have occurred.

The present invention has arisen to mitigate and/or obviate the disadvantages of the cargo container door, no matter the conventional or blast-resistant cargo container just mentioned above.

SUMMARY OF THE INVENTION

For the blast-resistant cargo container, the present invention provides a strengthened door which can be strongly connected to its adjacent panels in all four edges and can save operation space.

To achieve the objective, the strengthened door in accordance with the present invention includes a door panel horizontally slidably mounted on the cargo container. The door panel has an upper side, a lower side, a first vertical side and a second vertical side each hooked on the cargo container to provide overlapping joints to effectively limit blast damage to the inside of the cargo container and prevent the aircraft from being damaged.

Further benefits and advantages of the present invention will become apparent after a careful reading of the detailed description with appropriate reference to the accompanying drawings.

DETAILED DESCRIPTION OF THE INVENTION

Figure 1:
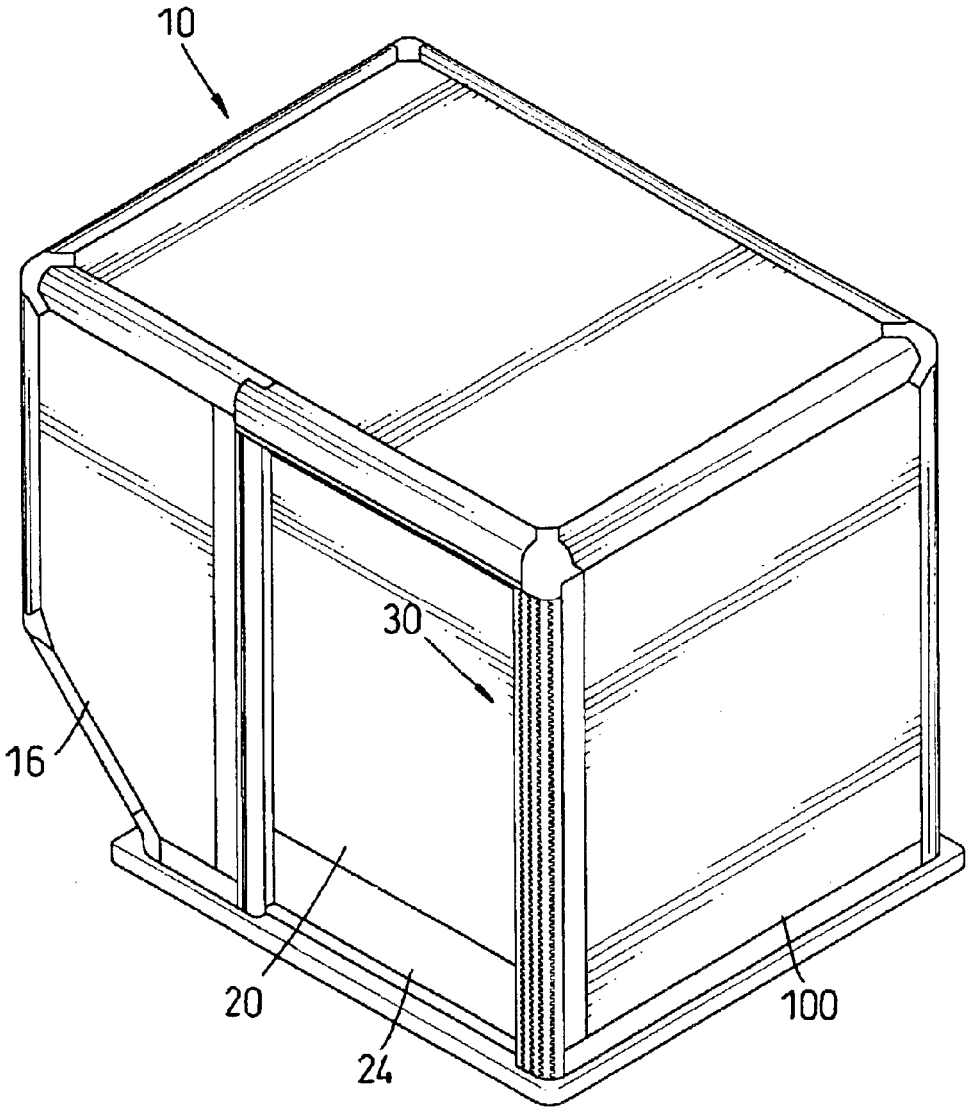
FIG. 1 is a perspective view of a blast-resistant cargo container in accordance with the present invention.

With reference to the drawings and initially to FIGS. 1–6, a strengthened door for a blast-resistant cargo container in accordance with the present invention comprises a door panel (20), an opening frame (not numbered). The opening frame (not numbered) is mounted on the adjacent panels of the door panel, i.e. around an opening in the cargo container (10). The door panel (20) adapted to be horizontally slidably mounted on the opening frame (not numbered) to close the cargo container (10). The opening frame is comprised of an upper frame (12), a lower frame (14), a first vertical frame (160), and a second vertical frame (30). The door panel (20) includes an upper side (22), a lower side (24), a first vertical side (26), and a second vertical side (28) which can be strongly connected to an upper frame (12), a lower frame (14), a first vertical frame (160), and a second vertical frame (30) respectively. The free end (302) of a second vertical frame (30) must be arbitrarily translatable and rotatable relative to its fixed end and can be operated by crew to securely close the door panel.

Figure 3:
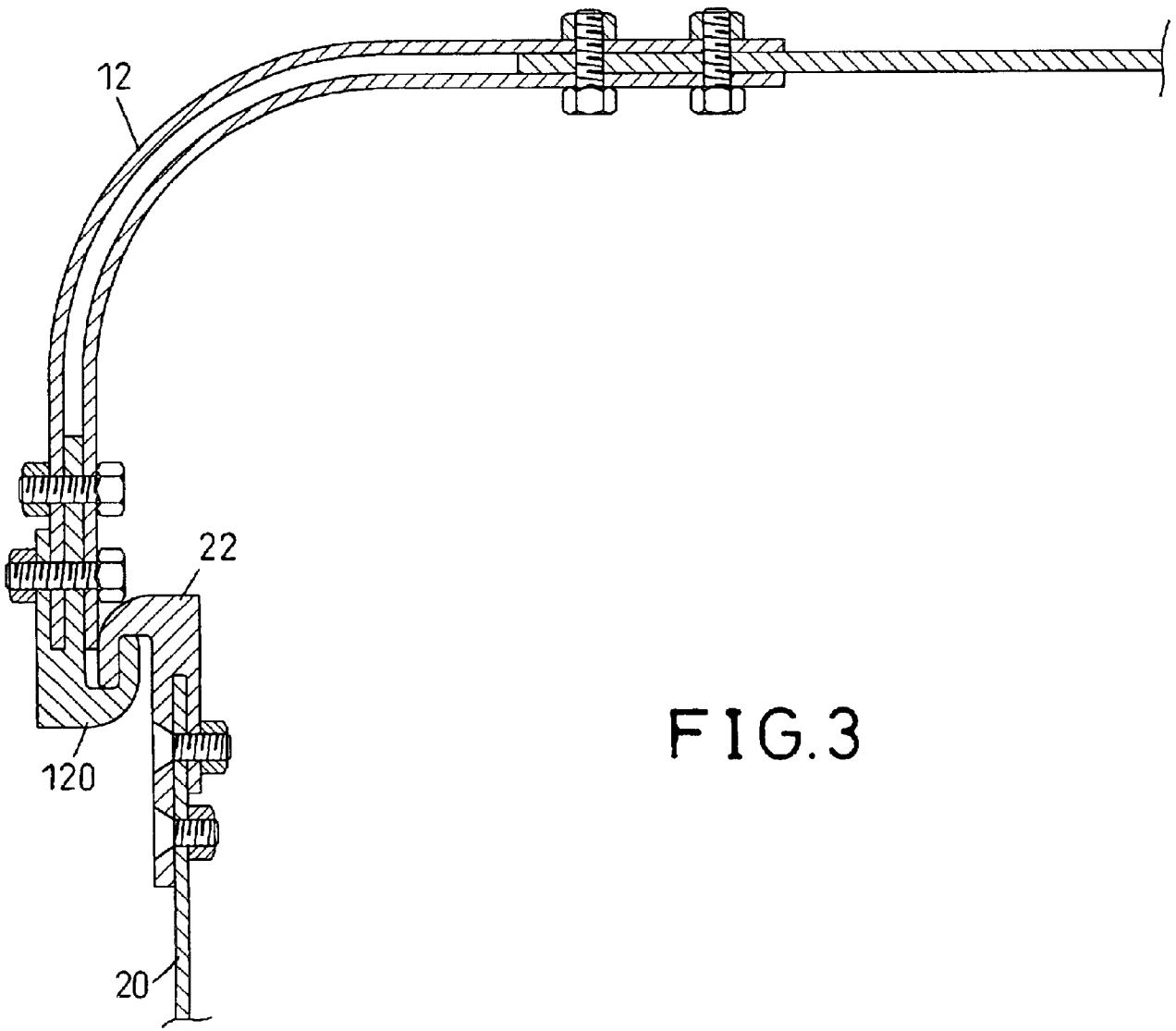
FIG. 3 is a cross sectional side plan view of the strengthened door along line 2—2 in FIG. 2.

With reference to FIG. 3, the upper frame (12) of the cargo container (10) has an upper frame hook (120) extending inward from the upper frame (12), and the hook-like upper side (22) of the door panel (20) extend outwardly. The upper frame hook (120) of the cargo container (10) and the upper side (22) of the door panel (20) are slidably interlocked. The door panel (20) is closed to provide a great tensile force when a bomb exploded in the cargo container (10). This connecting method provides a complete blast resistant to the cargo container (10).

Figure 4:
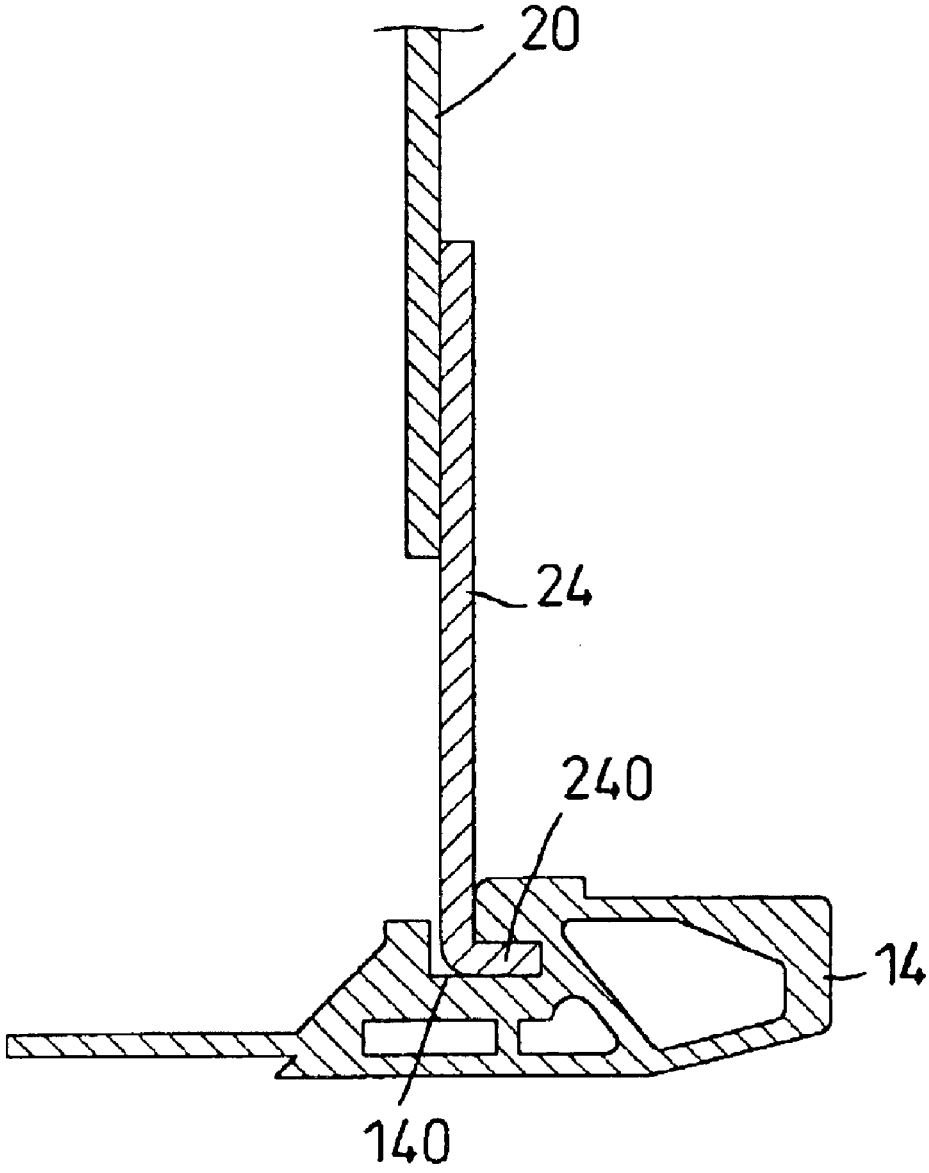
FIG. 4 is a cross sectional side plan view of the strengthened door along line 3—3 in FIG. 2.

With reference to FIG. 4, a groove (140) is defined horizontally in the lower frame (14). The lower side is formed by a connecting member (24) which is attached securely to the door panel (20). The connecting member (24) includes a lip (240) which is extended from a vertical lower edge of the connecting member (24). The lip (240) of the connecting member (24) slidably engages the groove (140) in the lower frame (14) of the cargo container (10) to provide a good connection between the lower frame (14) and the connecting member (24) of the door panel (20).

Figure 5:
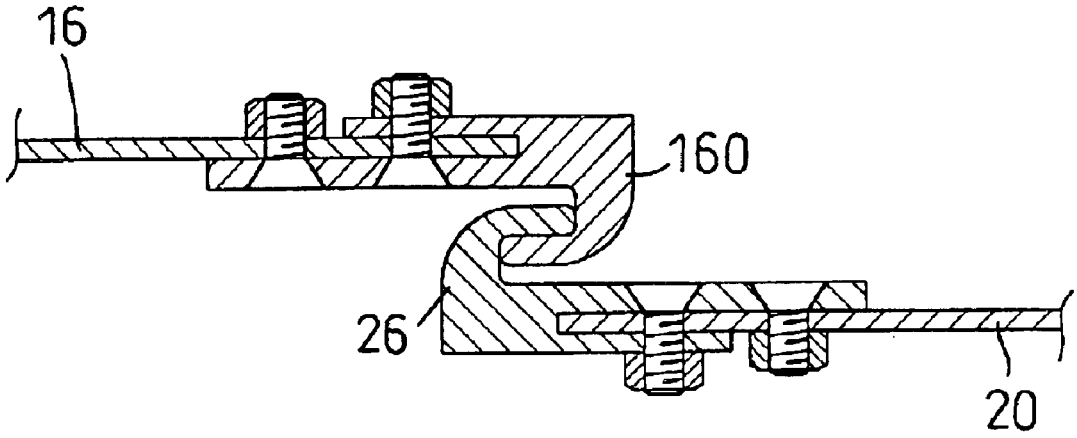
FIG. 5 is a cross sectional top plan view of the strengthened door along line 4—4 in FIG. 2.

With reference to FIG. 5, the first vertical frame is formed by a vertical frame hook (160) and is attached to the side panel (16). The first vertical side of the door panel (20) is formed by a first side hook (26) vertically. The first side hook (26) of the door panel (20) is selectively engaged to the vertical frame hook (160) when the door panel (20) closes the cargo container (10).

Figure 6:
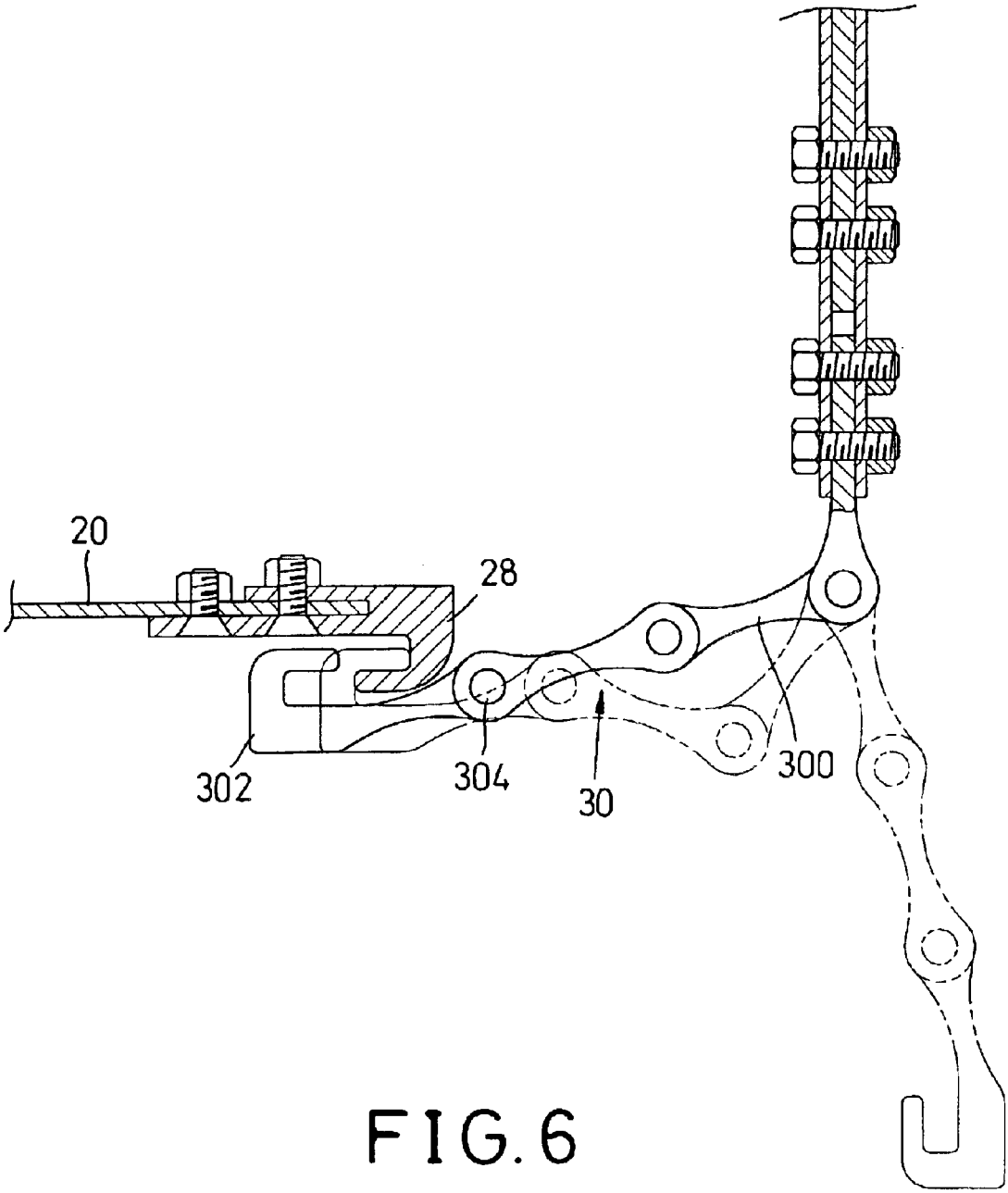
FIG. 6 is a cross sectional top plan view of the strengthened door along line 5—5 in FIG. 2.
Figure 7:
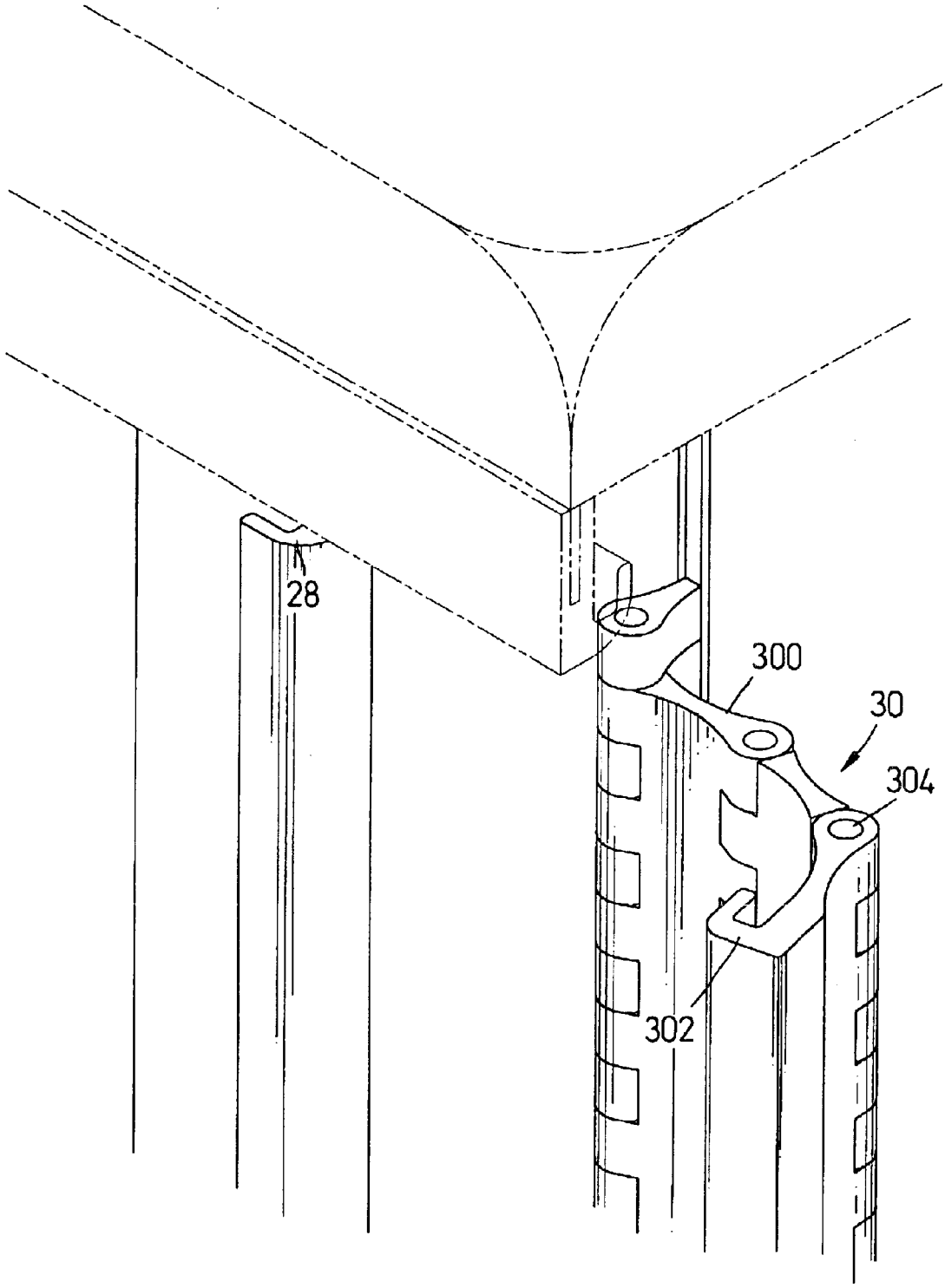
FIG. 7 is an enlarged perspective view of a hinged latch of the strengthened door in FIG. 6.

With reference to FIGS. 6 and 7, the second vertical frame is vertically formed by a hinged latch (30) and is mounted on one side of the cargo container (10) to hold the door panel (20) in place. The hinged latch (30) has two vertical extruded bars (300) which pivotally connected to each other at one side and to the hinge hook (302) and the fix end respectively at the other side by pivot pins (304). A hinge hook (302) is vertically formed on a free end of the hinged latch (30). A second vertical side of the door panel (20) is formed by a second side hook (28) vertically. The second side hook (28) provides a conjugation to fit the hinge hook (302) and to hold the door panel (20) in place when the door is closed.

Figure 2:
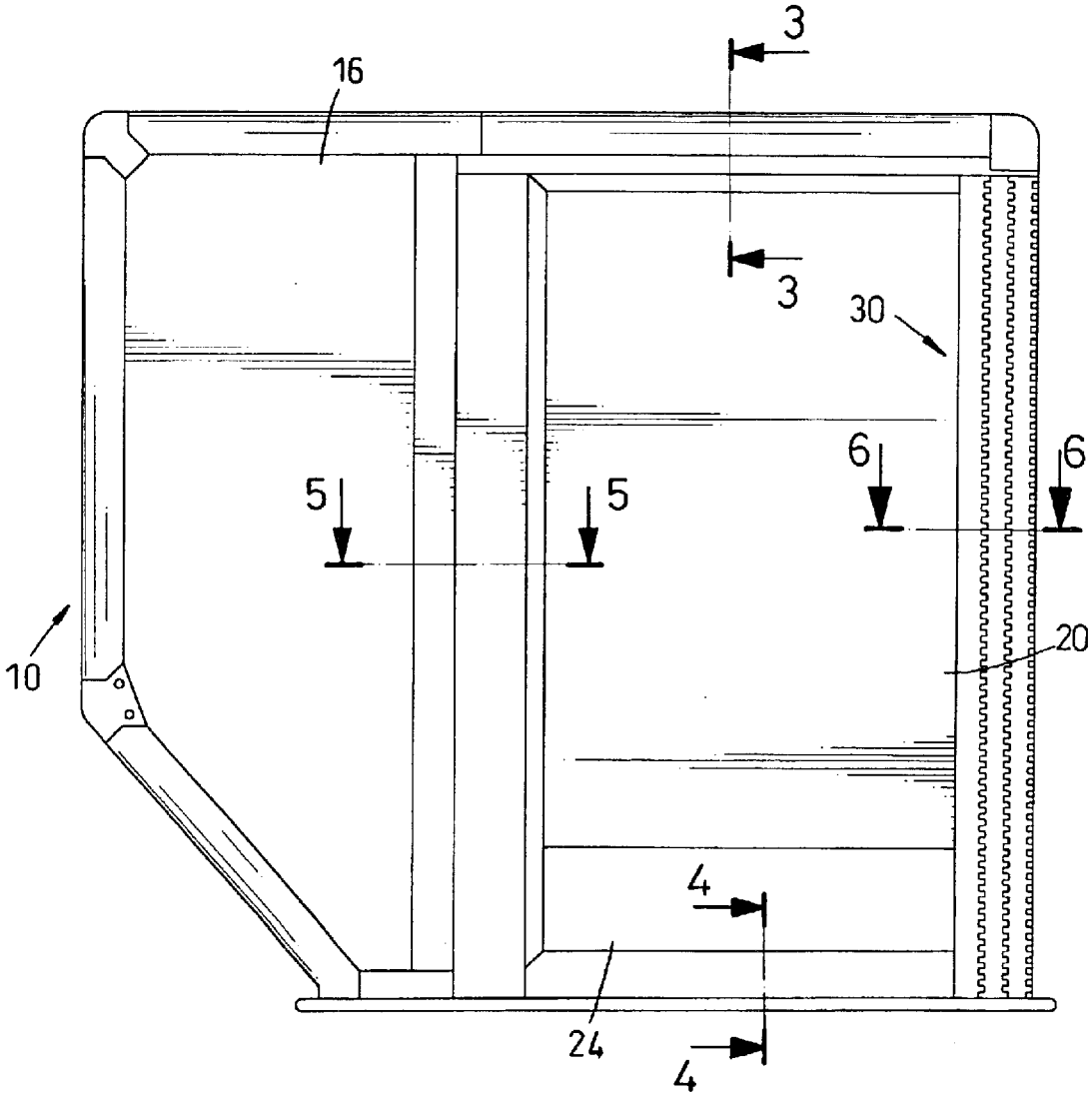
FIG. 2 is a front plan view of a strengthened door in FIG. 1.

To operate the strengthened door of the present invention, the door panel (20) slides on the upper frame hook (120) and the groove (140) in the lower frame (14) of the cargo container (10). With reference to FIG. 2, the blast-resistant cargo container (10) is closed by pulling the door panel (20) toward the hinged latch (30) and connecting the hinged latch (30) to the second side hook (28). When the door panel (20) is moved to a closed position, the first side hook (26) is hooked to the first vertical frame (160) at the same time which is conjugated to the first side hook (26) and connects to the left front panel (16).

The engagement between the strengthened door and the cargo container (10) can effectively limit blast damage to the inside of the cargo container and prevent the aircraft from being damaged. In order to open the strengthened door, the hinge hook (302) must be moved in the direction of the door panel (20) firstly to release the lock, and then rotate the hinged latch (30) to it. But an exploding blast generates a radial pressure that impacts the strengthened door. This pressure will let the hinged latch (30) stretch and cause the hinge hook to be pulled in the other direction. And it will cause the door to be closed even tighter. Thus, this strengthened door can be strongly connected to its adjacent panels in all four edges and can save operation space. Therefore, this invention can effectively hold the blast damage inside the cargo container.

Although the invention has been explained in relation to its preferred embodiment, it is to be understood that many other possible modifications and variations can be made without departing from the spirit and scope of the invention as hereinafter claimed.

What is claimed is:

1. A strengthened door installed on an opening frame which is mounted around an opening in a blast-resistant cargo container, comprising:

a door panel having an upper side, a lower side, a first vertical side and a second vertical side, wherein the upper side and the lower side of said door panel are configured to be securely connected to an upper frame and a lower frame of said opening frame, respectively, such that said door panel is configured to slide on said upper frame and said lower frame, wherein the first vertical side of said door panel is configured to be securely connected to a first vertical frame of said opening frame, wherein the second vertical side of said door panel is configured to be securely connected to a second vertical frame of said opening frame, wherein the second vertical frame comprises a free end and a fixed end, the free end being configured to be translatable and rotatable relative to the fixed end to securely close said door panel, and wherein the door panel is moveable to be opened or closed in a sliding motion and all four sides of the door panel are securely connected to said opening frame in a closed position by hook mechanisms.

2. The strengthened door as claimed in claim 1, wherein said lower side of said door panel comprises a connecting member attached to said door panel, and this connecting member have a lip extending from a vertical lower side of said connecting member, said lip adapted to be slidably hooked in a groove that is defined in said lower frame of the cargo container.

3. The strengthened door as claimed in claim 1, wherein said upper side of said door panel comprises an upper hook, which is adapted to be slidably hooked on an upper frame hook that is defined in said upper frame of the cargo container.

4. The strengthened door as claimed in claim 3, wherein said upper hook of the door panel extends outward from said upper side of the door panel and said upper frame hook extends inward from said upper frame.

5. The strengthened door as claimed in claim 1, wherein said first vertical side of said door panel comprises a first side hook vertically, which is adapted to selectively engage a vertical frame hook that being a conjugate hook of said first side hook and defined for said first vertical frame.

6. The strengthened door as claimed in claim 1, wherein said second vertical side of said door panel comprises a second side hook vertically, which is adapted to selectively hook a hinge hook formed on the free end of a hinged latch, said hinged latch forms part of said second vertical frame and can be operated to securely close the door panel.

7. The strengthened door as claimed in claim 6, wherein said hinged latch has two vertical extruded bars, said two vertical extruded bars are pivotally connected to each other at one side and to said hinge hook and the fix end respectively at the other side by pivot pins.

* * * * *